United States Patent [19]

Knapp

[11] Patent Number: 4,673,327

[45] Date of Patent: Jun. 16, 1987

[54] WASTE RECEPTACLE DUMPING APPARATUS

[75] Inventor: Johnn P. Knapp, Portland, Oreg.

[73] Assignee: Lear Siegler, Inc., Tualatin, Oreg.

[21] Appl. No.: 786,323

[22] Filed: Oct. 9, 1985

[51] Int. Cl.[4] ..... B65D 3/02

[52] U.S. Cl. ..... 414/408; 414/546; 414/421

[58] Field of Search ..... 414/406, 408, 403, 404, 414/407, 409, 419, 421, 422, 425, 554, 553, 552, 546, 556

[56] References Cited

U.S. PATENT DOCUMENTS

| | | | |
|---|---|---|---|
| 3,738,516 | 6/1973 | Wells | 414/421 X |
| 3,804,277 | 4/1974 | Brown et al. . | |
| 4,042,137 | 8/1977 | Hughes et al. . | |
| 4,365,922 | 12/1982 | Borders et al. | 414/406 |
| 4,422,814 | 12/1983 | Borders et al. | 414/303 |
| 4,479,751 | 10/1984 | Wyman et al. | 414/406 |

FOREIGN PATENT DOCUMENTS

| | | | |
|---|---|---|---|
| 2479783 | 10/1981 | France | 414/425 |
| 2500425 | 8/1982 | France | 414/425 |

*Primary Examiner*—Frank E. Werner

*Attorney, Agent, or Firm*—Stoel, Rives, Boley, Fraser & Wyse

[57] ABSTRACT

A dumping apparatus for roll-out cart waste receptacles employs a tipper plate which includes a lifting mechanism and a lock plate which includes a locking mechanism. The tipper and lock plates are mounted for pivotal movement about respective first and second pivot axes on a mounting support that is attachable to a waste collection vehicle. A hydraulic cylinder has a trunnion mounting to the mounting support and an extensible rod member that is pivotally attached at one end to the tipper plate. The hydraulic cylinder functions as a drive mechanism for moving the tipper plate about the first pivot axis. The pivotal movement of the tipper plate causes the lifting mechanism to engage the pick-up bar and thereby lift the receptacle to bring its lock bar into engagement with the locking mechanism of the lock plate. The lock plate at all times moves about the second pivot axis in cooperation with and in the same rotational sense as the driven pivotal movement of the tipper plate. The cooperation between the tipper plate and lock plate provides a positive locking slide mechanism for the receptacle as it is lifted and inverted to dump its contents into the waste collection vehicle. The first and second pivot axes are offset so that, after the lock bar engages the locking mechanism, the distance between the lifting and locking mechanisms does not change appreciably over the operational range of pivotal movement for lifting and inverting the receptacle and dumping its contents.

6 Claims, 9 Drawing Figures

WASTE RECEPTACLE DUMPING APPARATUS

BACKGROUND OF THE INVENTION

The present invention relates to refuse dumping apparatus, and in particular, a dumping apparatus for semi-automated portable refuse containers of the size typically used in residential and light commercial applications.

A growing number of mass producible portable refuse receptacles in the United States and Europe has created a need for economical and reliable dumping apparatus for handling them. These receptacles are typically plastic carts of the "roll-out" or "wheeled" type with capacities of about 0.75 cubic meters. Dumping apparatus for receptacles of this type are preferably adaptable for use on existing refuse collection vehicles, many of which include roll bar dumping mechanisms for containers of commercial size with capacities of up to about 12.0 cubic meters. The vehicles carrying dumping mechanisms of commercial size vary in age and design, and dumping apparatus for roll-out carts must be compatible with the existing dumping mechanism on the vehicle to facilitate the unobstructed operation of either one of them.

Dumping apparatus for portable roll-out carts have been used and are in use on refuse collection vehicles. In particular, U.S. Pat. No. 3,804,277 of Brown et al. describes a dumping mechanism for a portable waste container having on one of its sides a lower cross bar and an upper downwardly directed recess. The dumping mechanism includes a rotatable face plate having an upper saddle that is adapted to fit inside of the recess and a lower movable hook for automatically engaging the lower cross bar as the face plate is rotated to lift and invert the receptable. The dumping mechanism of Brown et al. suffers from the disadvantage of requiring an elaborate linkage assembly to position the lower movable hook into engagement with the cross bar at the proper time during a dumping cycle to stabilize the receptacle as it is lifted and inverted to empty its contents.

U.S. Pat. No. 4,042,137 of Hughes et al. describes a dumping apparatus that includes a rotatable lift platform which is adapted to engage and invert a portable refuse container to empty its contents. The rotatable platform includes a fixed hook, which engages an upper horizontal locking bar on the container, and a hydraulic piston, which has a hook secured to its free end. The hydraulic piston moves the hook into a locking position on a lower locking bar upon the start of frame rotation and retracts the hook from the locking position upon completion of a dumping operation. The Hughes et al. dumping apparatus suffers from the disadvantage of requiring the use of a hydraulic piston and other associated linkage to secure the container to the dumping apparatus during a dumping operation.

U.S. Pat. Nos. 4,365,922 and 4,422,814 of Borders describe dumping mechanisms that lift and invert a portable refuse container. The former and latter patents describe respective side-loading and ground level dumping mechanisms. Each patent describes a dumping mechanism having a frame mounted on a drive shaft of a rotary actuator that is secured to a refuse collection vehicle. Hook levers pivotally mounted to the frame engage an abutment on the refuse container and lock it into position on the frame as the container is inverted during a dumping operation. The Borders dumping mechanisms also suffer from the disadvantage of requiring elaborate linkage assemblies to stabilize the container as it is inverted.

U.S. Pat. No. 4,479,751 of Wyman et al. describes a dumping apparatus that includes a compound linkage system that interconnects a hook member and a receiving member. The linkage system promotes a relative sliding movement that changes the distance between the hook and receiving members so that they are operable to engage the horizontal lock bars of a roll-out cart receptacle during a dumping cycle. The Wyman et al. dumping apparatus suffers from the disadvantage of requiring the compound linkage system to provide a positive locking slide mechanism to secure the waste cart receptacle to it.

SUMMARY OF THE INVENTION

An object of the present invention is, therefore, to provide for portable refuse receptacles a dumping apparatus that is adaptable for use on waste collection vehicles of different types.

Another object of this invention is to provide such a dumping apparatus which is operable for dumping roll-out cart receptacles and is compatible for unobstructed use on a waste collection vehicle equipped with a separate dumping mechanism for a refuse container of a different type.

A further object of this invention is to provide such a dumping apparatus that minimizes the number of linkage assembly components and thereby is of compact size and affords a high degree of reliability.

Still another object of this invention is to provide in such a dumping apparatus a positive locking slide mechanism that employs a simple linkage assembly to engage the cross bars of a roll-out cart receptacle.

The dumping apparatus of the present invention employs a tipper plate which is mounted for pivotal movement about a first pivot axis on a mounting support, which is securable to a waste collector, such as a dump truck or other vehicle. A lock plate is mounted to the mounting support for pivotal movement about a second pivot axis and to the tipper plate for sliding movement relative to it. The tipper plate has a lifting means to engage the horizontal upper or pick-up bar of a roll-out cart receptacle, and the lock plate has a locking means to engage the horizontal lower or lock bar of the receptacle. A hydraulic cylinder, which has a trunnion mounting to the mounting support and an extensible rod that is pivotally attached to the tipper plate, functions as a drive means that moves the tipper plate about the first pivot axis to lift and invert the receptacle.

A dumping operation is accomplished by positioning the tipper plate and the lock plate adjacent the side of the roll-out cart receptacle on which the horizontal pick-up and lock bars are attached. The lifting means and locking means, each of which comprises a hooking member, are positioned initially within the space between the pick-up and lock bars. The lifting means is positioned in near engagement with the pick-up bar. Actuating the hydraulic cylinder pivotally moves the tipper plate in a rotational sense that causes the lifting means to engage the pick-up bar and lift the receptacle off the ground. The lock plate also pivotally moves in the same rotational sense but slides relative to the tipper plate in a direction that increases the separation distance between the lifting means and the locking means.

The tipper plate lifts the receptacle a predetermined distance that is approximately equal to the distance between the pick-up and lock bars. The locking means engages the receptacle, and the lock plate pivotally moves in the same rotational sense as and in cooperation with the tipper plate to maintain a relatively constant separation distance between the lifting means and the locking means to stabilize the receptacle over a range of pivotal movement operational for lifting and inverting the receptacle and dumping its contents into the waste collector. The relatively constant separation between the lifting means and the locking means results from the coordination of 1) the distance of offset between the first and second pivot axes and 2) the lengths of the radius from the first pivot axis to the pick-up bar and the radius from the second pivot axis to the lock bar.

The pivotal movement of the lock plate is, therefore, slaved to that of the tipper plate. The cooperation between the pivotal movement of the tipper plate and the lock plate provides for the roll-out cart receptacle a positive locking slide mechanism without the use of pivoted hooks and associated elaborate linkage assemblies.

The dumping apparatus is field adjustable for pick-up heights differing within a range of about 15 cm for accomplishing a dumping angle of at least 40° with respect to a vertical reference.

Additional objects and advantages of the present invention will be apparent from the following detailed description of a preferred embodiment thereof which proceeds with reference to the accompanying drawings.

DETAILED DESCRIPTION OF PREFERRED EMBODIMENT

Figure 2:
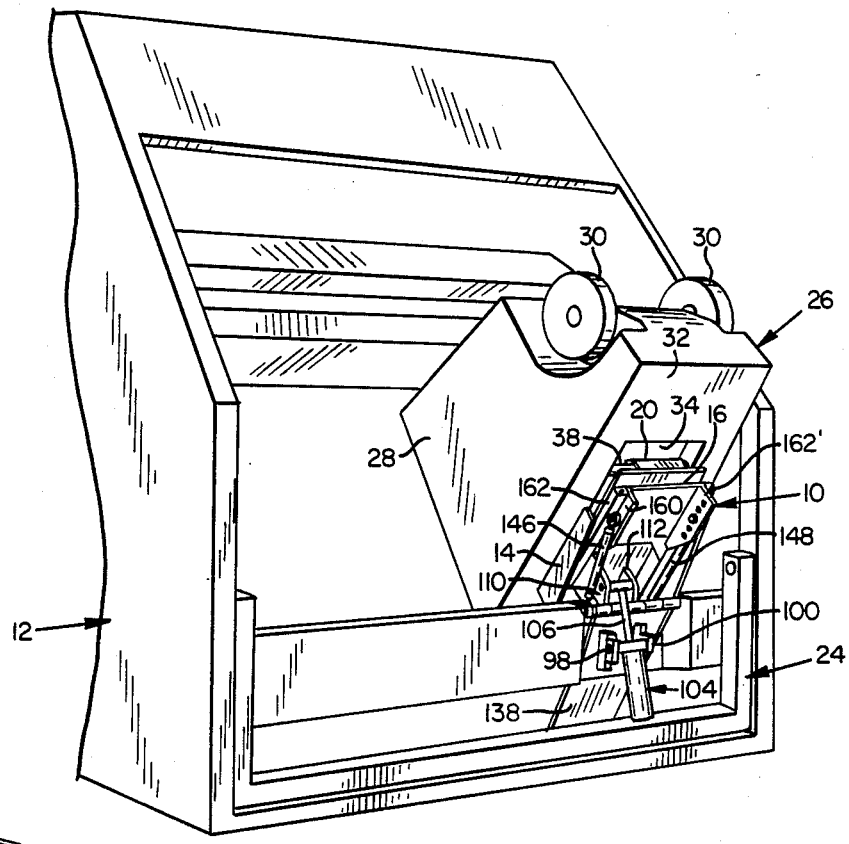
FIG. 2 is a perspective view showing the dumping apparatus of the present invention in its fully raised position to dump a roll-out cart receptacle unobstructed by a roll bar lift mechanism positioned at rest.
Figure 1:
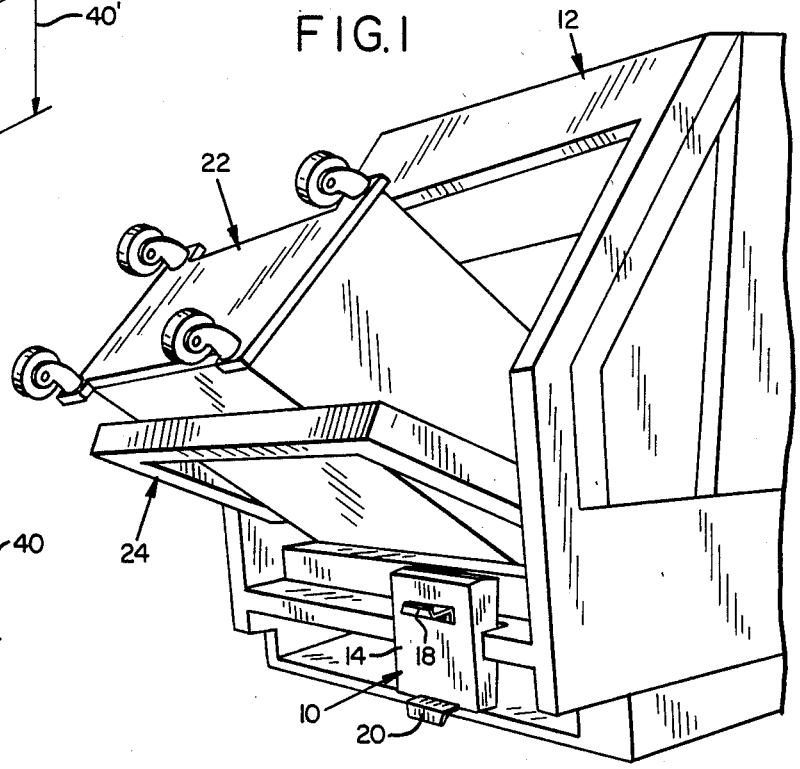
FIG. 1 is a perspective view showing the dumping apparatus of the present invention positioned at rest on a dump truck to facilitate unobstructed dumping of a large container by a separate roll bar lift mechanism.

FIGS. 1 and 2 show the dumping apparatus 10 of the present invention attached to the rear end of a refuse collector or dump truck 12 at rest and in its fully raised position, respectively. With reference to FIGS. 1 and 2, dumping apparatus 10 includes a tipper plate 14 and a lock plate 16, each being mounted for pivotal movement about a mounting support securable to refuse collector 12, as will be further described below. Tipper plate 14 carries a lifting means or upwardly directed hooking member 18, and lock plate 16 carries a locking means or downwardly directed hooking member 20. Hooking members 18 and 20 engage the respective horizontal pick-up and lock bars of a roll-out cart receptacle (not shown).

FIG. 1, which shows a large refuse container 22 supported in its fully raised position by a roll bar dumping mechanism 24, indicates that dumping apparatus 10 in its rest position is out of the way of and thereby facilitates the unobstructed dumping of container 22 by dumping mechanism 24. FIG. 2, which shows a roll-out cart receptacle 26 supported in its fully raised position by dumping apparatus 10, indicates that dumping mechanism 24 in its rest position is out of the way of and thereby facilitates the dumping of container 26 by dumping apparatus 10. It will be appreciated that dumping apparatus 10 is compatible for use on refuse collection vehicles equipped with other types of dumping mechanisms.

Figure 3B:
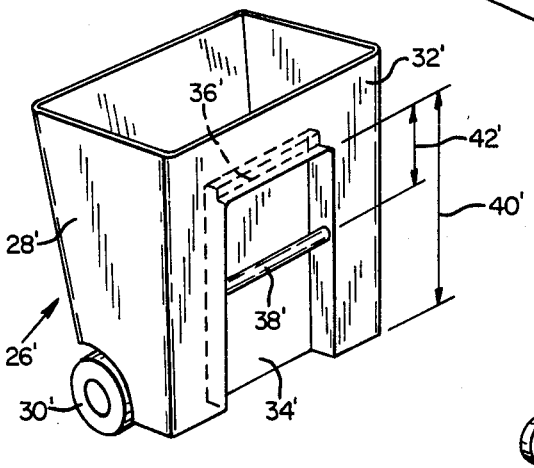
FIGS. 3A and 3B are isometric views of two types of roll-out cart receptacles which the dumping apparatus of the present invention is operable to empty.
Figure 3A:
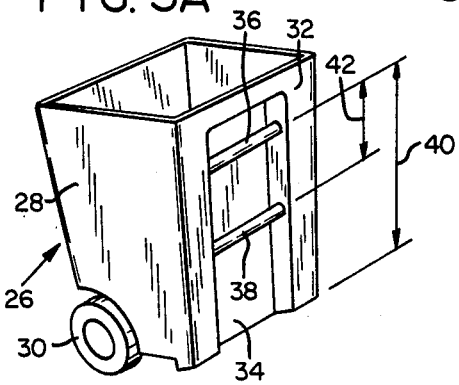

FIGS. 3A and 3B show exemplary cart receptacles 26 and 26' with alternative types of pick-up members but of otherwise the same design. The portions of the cart receptacle of FIG. 3B corresponding to those of the cart receptacle of FIG. 3A are, therefore, designated by identical reference numerals followed by primes. With reference to FIG. 3A, cart receptacle 26 includes a receptacle portion 28 that is supported on a pair of wheels 30, of which only one wheel is shown. Side 32 of cart receptacle 26 includes a recess 34 in which a pick-up bar 36 and a lock bar 38 are secured in spaced-apart horizontal relationship. Upwardly directed hooking member 18 and downwardly directed hooking member 20 of dumping apparatus 10 (FIG. 1) engage pick-up bar 36 and lock bar 38, respectively, in the manner described below.

FIG. 3B shows a design variation of the pick-up bar 36 shown in FIG. 3A. In FIG. 3B, pick-up bar 36 is removed and replaced by a cavity 36' that is molded into and along the top margin of receptacle portion 28.

Each of the distances 40 and 40' between the ground and the centers of the respective pick-up bar 36 and cavity 36' ranges typically from between 86 and 91 cm. Each of the distances 42 and 42' between lock bar 38 and the centers of the respective pick-up bar 36 and cavity 36' is about 38 cm.

Figure 4:
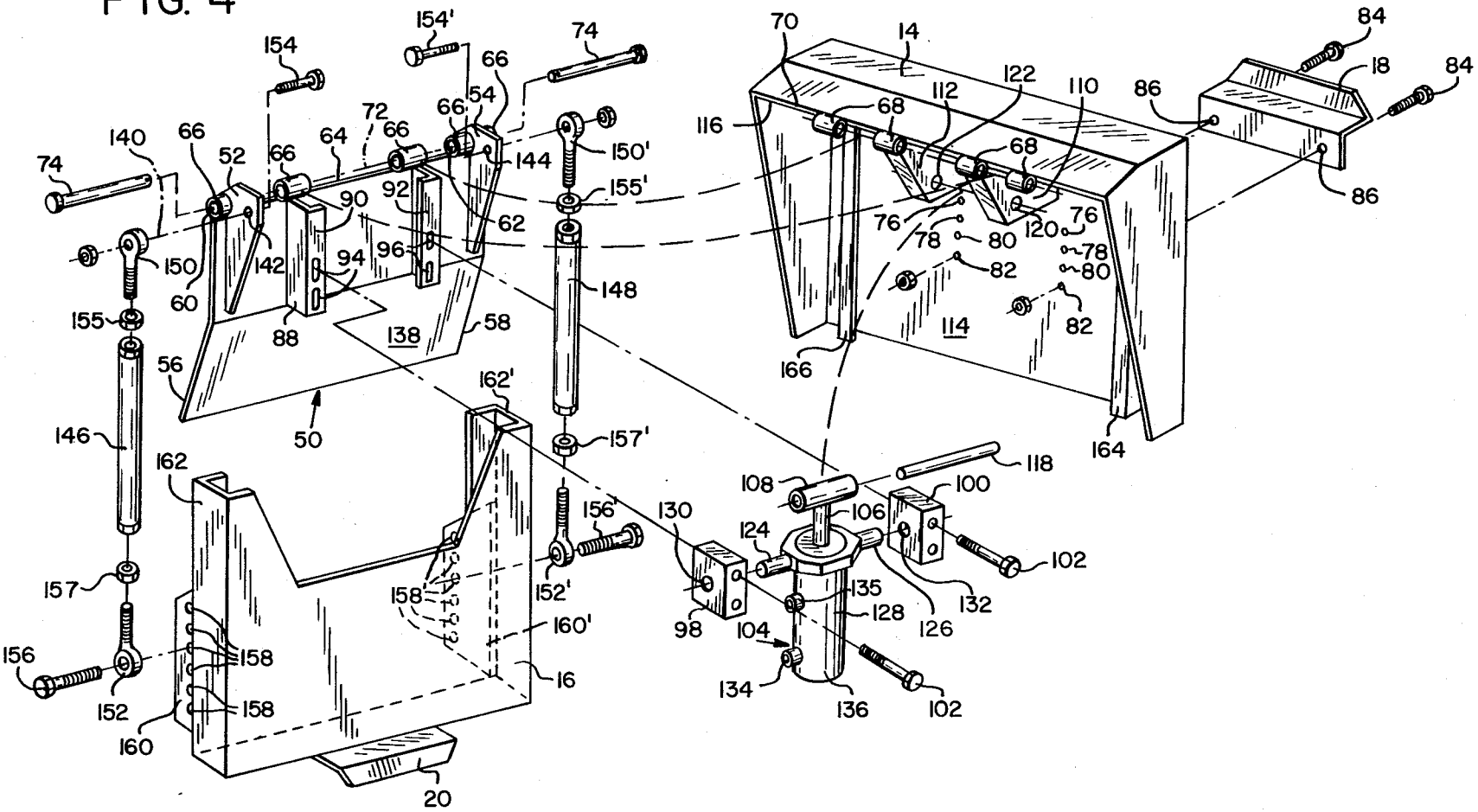
FIG. 4 is an exploded view of the dumping apparatus of the present invention.

FIG. 4 is an exploded view of dumping apparatus 10 of the present invention. With reference to FIG. 4, dumping apparatus 10 comprises a mounting support assembly 50 that is securable by any suitable means within a recessed area on the rear end of refuse collector 12, as is best shown in FIGS. 1 and 2. Mounting support 50 carries a pair of support flanges 52 and 54 which are spaced apart and positioned in generally parallel relationship along its respective side margins 56 and 58. Support flanges 52 and 54 have respective axially aligned bores 60 and 62 located near the upper side margin 64 of mounting support 50.

Six cylindrical sleeves 66 of the same diameter as bores 60 and 62 are welded to upper side margin 64 of mounting support 50. One of the sleeves 66 is welded to each side of both support flanges 52 and 54, and two of the sleeves 66 are in intermediate locations between flanges 52 and 54. Four axially aligned cylindrical sleeves 68 of the same diameter as cylindrical sleeves 66 are welded to the rear upper side margin 70 of tipper plate 14. Sleeves 68 are spaced apart along upper side margin 70 so that they can fit in the spaces between and in complementary relationship with sleeves 66 on mounting support 50 to mount tipper plate 14 onto mounting support 50 for pivotal movement about a first pivot axis 72. Pivot axis 72 is defined by a pair of pivot pins 74 which fit through the apertures of sleeves 66 and 68 and hold tipper plate 14 and mounting support 50 together.

Tipper plate 14 has four pairs of spaced-apart horizontally aligned bores 76, 78, 80, and 82 that are arranged in two vertical columns to provide four different vertical mounting positions for hooking member 18. Each one of a pair of cap screws 84 passes through bores 86 and one of the pairs of bores 76, 78, 80, and 82 in tipper plate 14 to secure hooking member 18 in the desired vertical position.

Mounting support 50 also includes a bracket assembly 88 that is positioned between support flanges 52 and 54. Bracket assembly 88 has two vertically disposed mounting slides 90 and 92, each having a pair of vertically aligned slots 94 and 96, respectively. Bear:ng blocks 98 and 100 are mounted to and slidably adjustable in the vertical direction on the respective mounting slides 90 and 92. Cap screw assemblies 102 secure bearing blocks 98 and 100 to bracket assembly 88.

A hydraulic cylinder 104 functions as a drive means for effecting the pivotal movement of tipper plate 14 about pivot axis 72. Cylinder 104 includes an extensible rod member 106, the free end of which is mounted to the surface of a cylindrical sleeve 108. The length of sleeve 108 equals the distance between a pair of support flanges 110 and 112 that are welded to the inner side surface 114 and inner top surface 116 of tipper plate 14. A cylinder pin 118 passes through a pair of axially aligned bores 120 and 122 in the respective support flanges 110 and 112 and through sleeve 108 to pivotally secure the free end of extensible rod 106 of cylinder 104 to tipper plate 14.

Cylinder 104 has a pair of stub shafts 124 and 126 which project from opposite sides of its body portion 128 and which are received by a pair of axially aligned bores 130 and 132 through the surfaces of the respective bearing blocks 98 and 100 to form a trunnion mount for cylinder 104. An inlet port 134 positioned near the lower end 136 of cylinder 104 delivers fluid from a hydraulic fluid supply (not shown) to move extensible rod 106 in and out of body portion 128 of cylinder 104 and thereby move tipper plate 14 about its pivot axis 72 to raise or lower a cart receptacle that is in engagement with it. An outlet port 135 provides a return path from cylinder 104 back to the fluid supply. The trunnion mounting of cylinder 104 facilitates its positioning against the angularly inclined lower portion 138 of mounting support 50 when dumping apparatus 10 is at rest and thereby allows the unobstructed operation of a separate dumping mechanism on the dump truck or other refuse collection vehicle to which dumping apparatus 10 is attached.

Lock plate 16 is mounted for pivotal movement about a second pivot axis 140 which is defined along the centers of axially aligned bores 142 and 144 in the respective support flanges 52 and 54. As will be described below, the rotational sense of the pivotal motion of lock plate 16 is governed by that of tipper plate 14. Drag links 146 and 148 of adjustable fixed lengths are pivotally connected to the respective support flanges 52 and 54. Since drag links 146 and 148 are of the same design and function, the following discussion is directed only to drag link 146. The components of drag link 148 that correspond to those of drag link 146 are, therefore, designated by identical reference numerals followed by primes.

Drag link 146 has threaded rod eyes 150 and 152 at its respective upper and lower end portions. Cap screw assembly 154 passes through the bore in rod eye 150 and bore 142 of support flange 52 to pivotally mount the upper end portion of drag link 146 to mounting support 50. Cap screw assembly 156 passes through the bore in rod eye 152 and one of six spaced-apart vertically aligned bores 158 in a bracket 160 which is welded to lock plate 16 near the side margin of a U-shaped channel 162. The fixed length of drag link 146 can be adjusted by about two inches by rotating the threaded rod eyes 150 and 152 on the ends of drag link 146. Rod eyes 150 and 152 are held into position by tightening the respective lock nuts 155 and 157. The distance between adjacent ones of bores 158 is the same as the vertical distance between adjacent ones of bores 76, 78, 80, and 82 on tipper plate 14. The choice of bores in the tipper and lock plates is coordinated such that the vertical distance between hooking members 18 and 20 remains essentially constant. This provides a field-adjustable overall height adjustment of up to 15 cm for dumping apparatus 10 to facilitate its use with cart receptacles with pick-up and lock bars of different heights above the ground.

Drag link 148 is similarly pivotally mounted at its upper end to support flange 54 on mounting support 50 and at its lower end portion to a bracket (shown in phantom) corresponds to bracket 160.

Figure 5A:
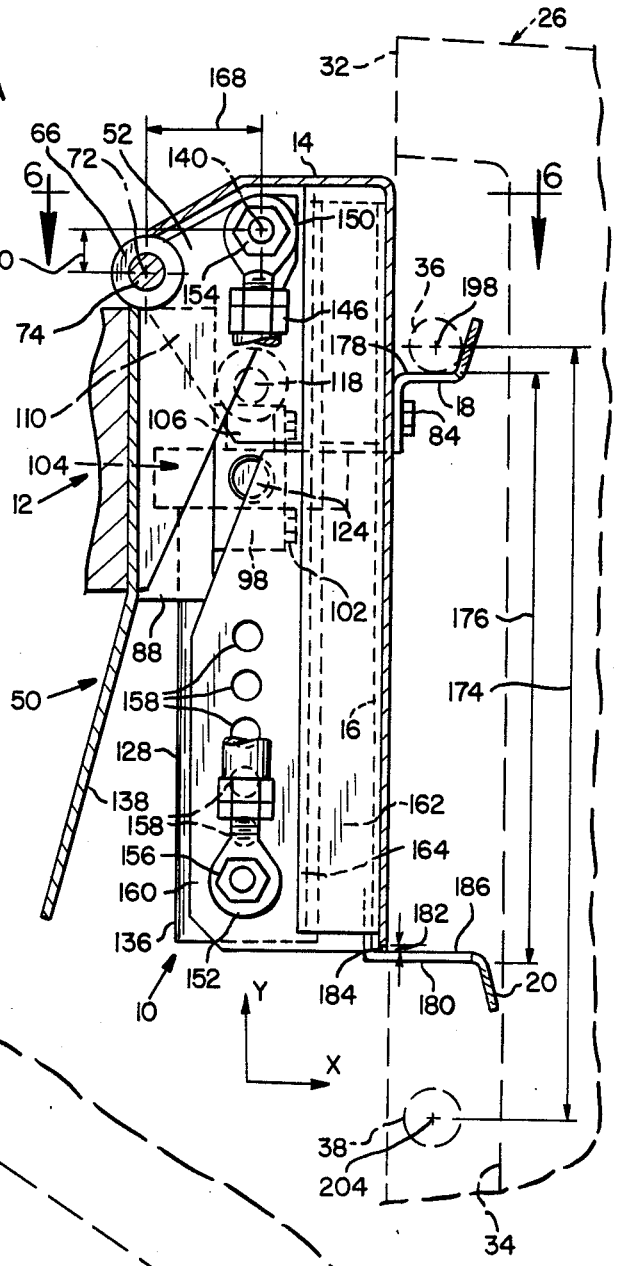
FIGS. 5A, 5B, and 5C are diagrams showing cross sectional side elevation views of the dumping apparatus of the present invention, respectively, at rest, in an intermediate raised position, and in the fully raised position.
Figure 5B:
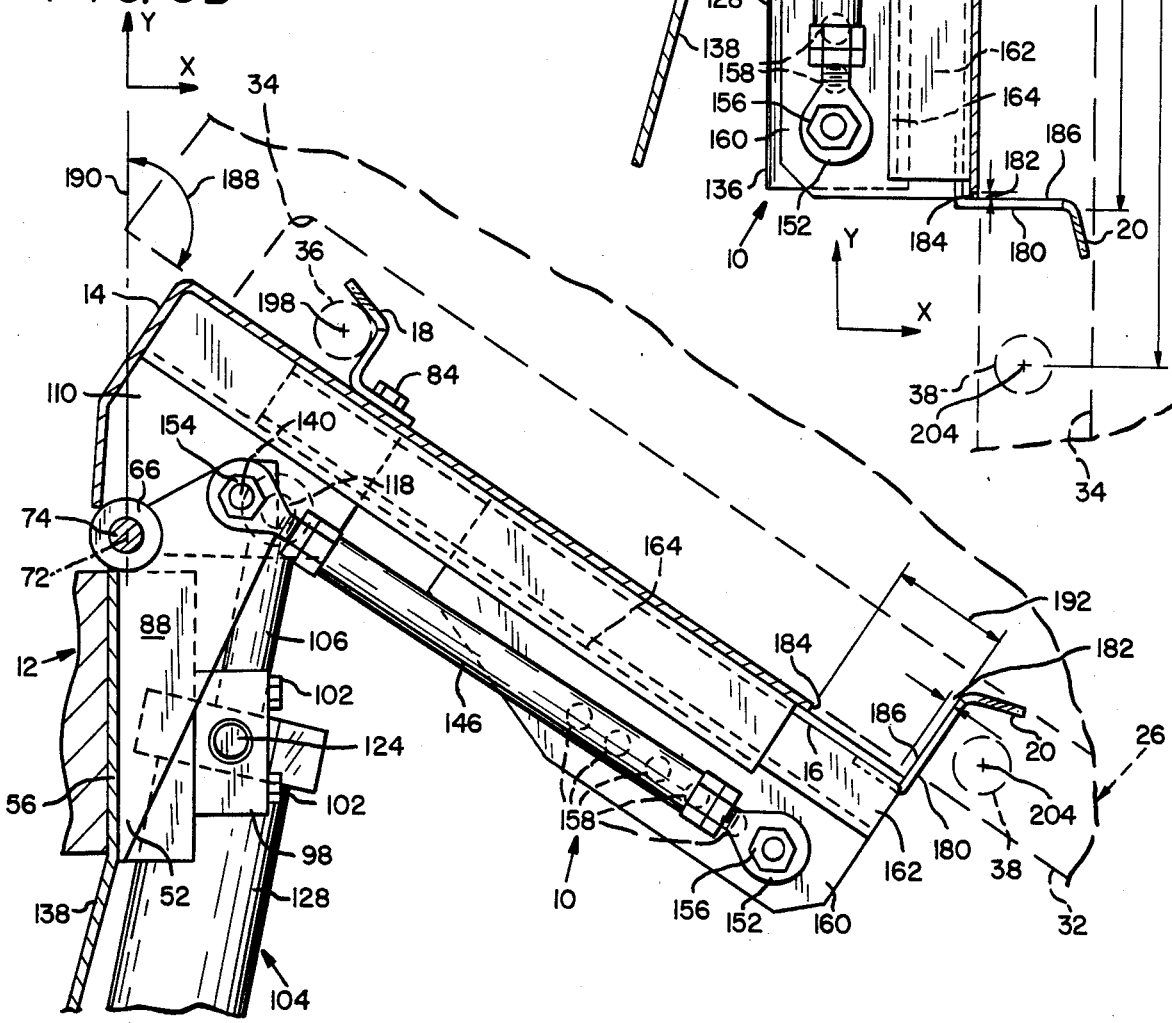
Figure 5C:
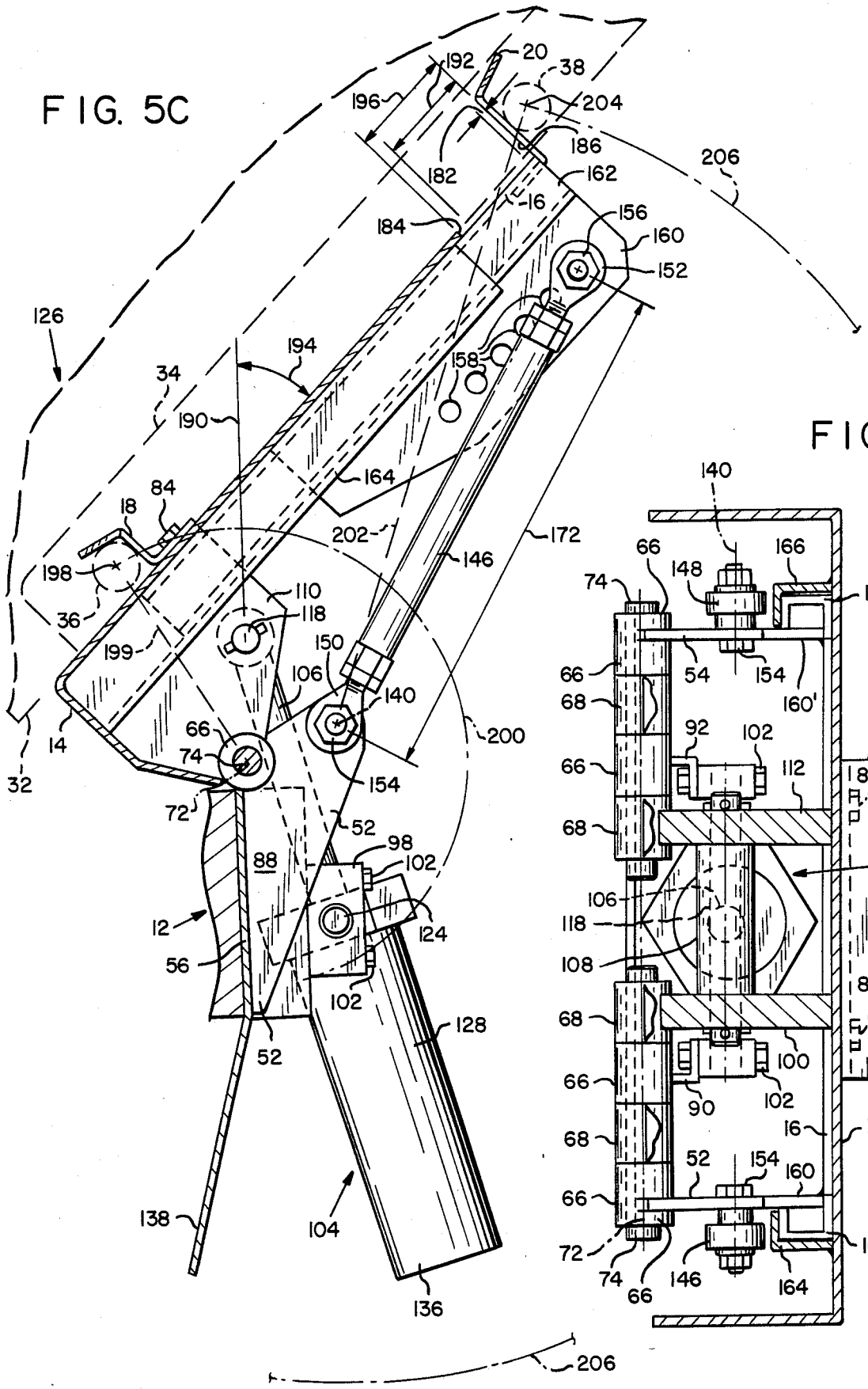
Figure 6:
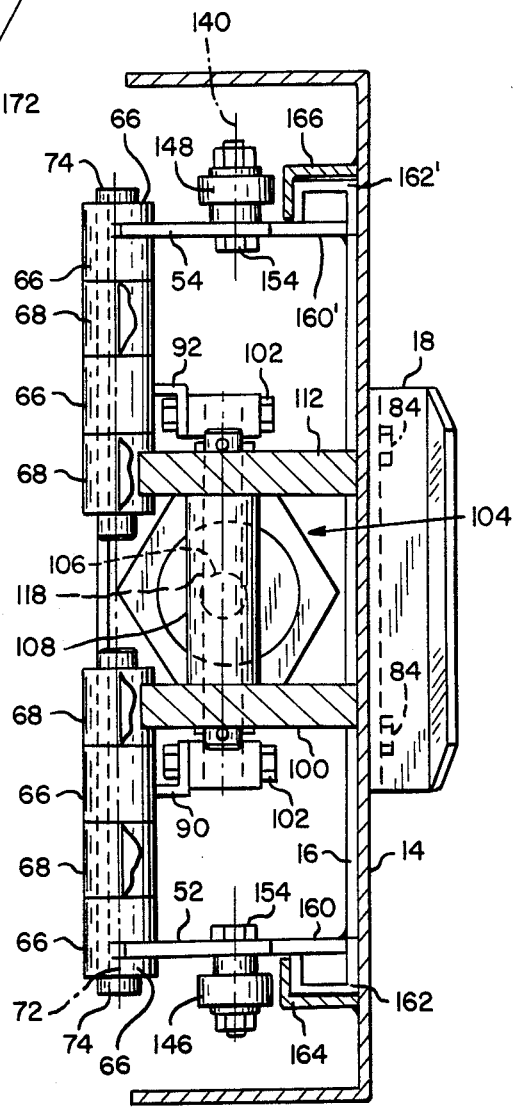
FIG. 6 is a sectional view taken along line 6—6 of FIG. 5A.

FIGS. 5A, 5B, and 5C are diagrams showing cross sectional side elevation views of dumping apparatus 10, respectively, at rest, in an intermediate raised position, and the fully raised position. FIG. 6 is a sectional view showing the mechanical interconnection between tipper plate 14 and lock plate 16.

With reference to FIGS. 4, 5A–5C, and 6, inner surface 114 of tipper plate 14 has a pair of spaced-apart opposed right angle slide members 164 and 166. Slide members 164 and 166 receive the respective U-shaped channels 162 and 162' of lock plate 16 and serve as guides to promote the relative sliding movement between them as dumping apparatus 10 pivotally moves as shown in FIGS. 5A–5C. This slide mechanism ensures that cart receptacle 26 rests flat against the surfaces of tipper plate 14 and lock plate 16 as it is lifted and inverted during a dumping cycle.

With reference to FIG. 5A, dumping apparatus 10 is shown at rest and in position adjacent side 32 of an exemplary cart receptacle 26 to begin a dumping operation. First pivot axis 72 is positioned laterally of and below second pivot axis 140 as shown. The distance 168 between first pivot axis 72 and second pivot axis 140 in the horizontal or X direction is about 6.1 cm, and the distance 170 between first pivot axis 72 and second pivot axis 140 in the vertical or Y direction is about 2.2 cm. Drag link 146 is secured to the bottom bore 158 in bracket 160 of lock plate 16 and has a fixed length 172 of about 34 cm (FIG. 5C).

For the cart receptacle shown, the center-to-center distance 174 between pick-up bar 36 and lock bar 38 is about 38 cm. The distance 176 between the pick-up bar contacting surface 178 of hooking member 18 and the lock bar contacting surface 180 of hooking member 20 is adjusted to be about 31 cm. The distance 182 between the lower side margin 184 of tipper plate 14 and the lock bar noncontacting surface 186 of lock plate 16 is about 0.2 cm.

At the beginning of a dump cycle, surface 178 of hooking member 18 is positioned underneath and in near engagement with pick-up bar 36, and hooking member 20 is positioned within the space between pick-up bar 36 and lock bar 38. Extensible rod member 106 moves outwardly of body portion 128 of hydraulic cylinder 104 to impart pivotal movement of tipper plate 14 and thereby lift it to engage pick-up bar 36. Tipper plate 14 travels about 1.0 cm in the Y direction until surface 178 of hooking member 18 engages pick-up bar 36. Lock plate 16 pivotally moves in cooperation with and in the same rotational sense as tipper plate 14. Lock plate 16 simultaneously slides outwardly and downwardly along slide members 164 and 166 from underneath tipper plate 14 to increase the distance between hooking members 18 and 20. After it engages pick-up bar 36, tipper plate 14 lifts cart receptacle 26 off the ground about 4.5 cm in the Y direction, whereupon lock bar 38 engages surface 180 of hooking member 20. At this time, the distance between lower side margin 184 of tipper plate 14 and lock bar noncontacting surface 186 is about 5.7 cm. Increasing the extension of rod member 106 continues the driven pivotal movement of tipper plate 14 and causes lock plate 16 to pivotally move in the same rotational sense as that of tipper plate 14.

With reference to FIG. 5B, cart receptacle 26 is shown in an intermediate raised position, which represents a tip angle 188 of 120° with respect to vertical reference line 190. Angle 188 of 120° represents pivotal movement of 60° by dump apparatus 10 from the rest position. The distance 192 between lower side margin 184 of tipper plate 14 and lock bar noncontacting surface 186 after 60° of pivotal movement is about 6.1 cm. Lock bar 38 is spaced a small distance from surface 180 of hooking member 20.

With reference to FIG. 5C, cart receptacle 26 is shown in its fully raised position, which represents a tip angle 194 of 45° with respect to vertical reference line 190. Angle 194 of 45° represents pivotal movement of 135° by dump apparatus 10 from the rest position. This angle is sufficient to empty the contents of cart receptacle 26 into the refuse collection vehicle 12. The distance 196 between lower side margin 184 of tipper plate 14 and lock bar noncontacting surface 186 after 135° of pivotal movement is about 7.2 cm. It will be appreciated that in the fully raised position, the load supplied by cart receptacle 26 is transferred to lock plate 16 and direct to mounting support 50 by way of drag links 146 and 148, which function as compression struts.

The operational range of pivotal movement of 135° of dumping apparatus 10 from the rest position to the fully raised position causes a total linear displacement of about 7.2 cm between lower side margin 184 of tipper plate 14 and lock bar noncontacting surface 186. A corresponding increase in linear displacement of about 1.5 cm develops between hooking members 18 and 20 after engagement with the respective pick-up bar 36 and lock bar 38. Hooking members 18 and 20 tend, therefore, to force apart pick-up bar 36 and lock bar 38 to stabilize cart receptacle 26 during the dumping cycle. Since the lengths of drag links 146 and 148 are adjustable, the distance between hooking members 18 and 20 can be adjusted to provide a snug fit between dumping apparatus 10 and cart receptacle 26 when they are in the fully raised position.

Cart receptacle 26 can be wheeled away from dumping apparatus 10 after it pivotally moves in the opposite rotational sense from the fully raised position to the rest position to complete the dumping cycle.

Coordinating the position of pivot axis 72 relative to second pivot axis 140 and the selection of the lengths of the radius from first pivot axis 72 to pick-up bar 36 and the radius from second pivot axis 140 to lock bar 38 enables the relatively constant separation between hooking members 18 and 20 over the range of pivotal movement from the point of engagement of hooking member 20 to the fully raised position.

With reference to FIG. 5C, the angular displacement of a radius 199, which is defined by the distance of about 15.5 cm between first pivot axis 72 and the center 198 of pick-up bar 36, describes an arc 200. Similarly, the angular displacement of a radius 202, which is defined by the distance of about 42.3 cm between second pivot axis 140 and the center 204 of lock bar 38 after its engagement with hooking member 20, describes an arc 206. The distance between centers 198 and 204 does not change appreciably for equal increments of angular displacement of centers 198 and 204 along the respective arcs 200 and 206 over the operational range of pivotal motion when dumping apparatus 10 is in engagement with lock bar 38. The result is a positive locking slide mechanism that requires relatively few components to engage pick-up bar 36 and lock bar 38 and thereby stabilize cart receptacle 26 during a dumping operation.

It will be appreciated that dumping apparatus 10 is of compact design and that the low number of moving parts eases maintenance requirements and provides a high degree of reliability. Moreover, the parallel movement of lock plate 16 relative to the surface of tipper plate 14 provides a self-cleaning mechanism by which the force of gravity moves dirt and other contaminants down and free from dumping apparatus 10 while it is in the rest position.

It will be obvious to those having skill in the art that many changes may be made in the above-described details of the preferred embodiment of the present invention. For example, dumping apparatus 10 can be adapted as a side loading attachment to a refuse collection vehicle. The scope of the present invention should be determined, therefore, only by the following claims.

What is claimed is:

1. An apparatus for inverting a receptacle to dump its contents into a refuse collector, wherein the receptacle has two spaced-apart handle elements, the apparatus comprising:

a mounting support securable to the refuse collector;

a tipper plate pivotally mounted to the mounting support for movement about a first pivot axis, the tipper plate having a first hooking member fastened thereto for engaging one of the handle elements of the receptacle;

a lock plate mounted to the tipper plate for sliding movement relative thereto, the lock plate having a second hooking member fastened thereto for engaging the other handle element of the receptacle;

a drag link having one end pivotally connected to the mounting support to define a second pivot axis that is offset from the first pivot axis, the drag link having another end that is pivotally connected to the lock plate;

drive means pivotally mounted to the mounting support about a third pivot axis and pivotally connected to the tipper plate about a fourth pivot axis, the drive means configured for moving the tipper plate about the first pivot axis between a rest position and a dump position through an intermediate receptacle-locking position, wherein the receptacle is substantially upright when in the rest position and is substantially inverted when in the dump position, and wherein the first and second hooking elements move apart and engage their associated handle elements when the receptacle is moved between the rest position and the dump position.

2. The apparatus of claim 1 in which the first pivot axis is spaced laterally of and below the second pivot axis.

3. The apparatus of claim 1 in which the tipper plate includes guide means that receive channel means on the lock plate to guide the relative sliding movement between the tipper plate and the lock plate.

4. The apparatus of claim 1 in which the operational range of pivotal movement of the tipper plate is at least about 130°.

5. The apparatus of claim 1 wherein the first and second hooking members engage the handle elements and exert forces on them in opposite directions to stablize the receptacle as it is moved from the receptacle-locking position into the dump position.

6. The apparatus of claim 1 wherein the drive means includes a cylinder and extensible rod member, the cylinder having first and second end portions, the drive means further including trunnion mounting means connected to the cylinder between the first and second end portions for pivotally mounting the cylinder to the mounting support about the third pivot axis, the rod member being pivotally connected to the tipper plate about the fourth pivot axis.

* * * * *